US005997363A

United States Patent [19]

Joly

[11] Patent Number: 5,997,363

[45] Date of Patent: Dec. 7, 1999

[54] SINGLE PIECE ELECTRICAL TERMINAL FOR SEALED CONNECTORS

[75] Inventor: Jean Claude Joly, Osny, France

[73] Assignee: The Whitaker Corporation, Wilmington, Del.

[21] Appl. No.: 08/976,589

[22] Filed: Nov. 24, 1997

[30] Foreign Application Priority Data

Dec. 18, 1996 [FR] France ..... 96 402801

[51] Int. Cl.[6] ..... H01R 13/432

[52] U.S. Cl. ..... 439/748

[58] Field of Search ..... 439/744, 745, 439/746, 747, 748, 749

[56] References Cited

U.S. PATENT DOCUMENTS 3,363,224 1/1968 Gluntz ..... 439/872

4,660,915 4/1987 Mantlik ..... 439/747

5,664,969 9/1997 Peterson et al. ..... 439/746

FOREIGN PATENT DOCUMENTS 0 178 102-B1 4/1986 European Pat. Off. ..... H01R 13/115

41 31 470-C2 4/1993 Germany ..... H01R 13/434

*Primary Examiner*—Paula Bradley

*Assistant Examiner*—Katrina Davis

*Attorney, Agent, or Firm*—Driscoll A. Nina

[57] ABSTRACT

A single piece electrical receptacle terminal is provided with a box-shaped contact section having resilient outwardly biased locking lances. The side walls and locking lances are provided with guide members at the lance free end in order to assist insertion and extraction through a family seal without damage to the seal or the contact.

11 Claims, 3 Drawing Sheets

SINGLE PIECE ELECTRICAL TERMINAL FOR SEALED CONNECTORS

BACKGROUND OF THE INVENTION

1. Field of the Invention

This invention relates to a stamped and formed single piece electrical terminal for use in sealed electrical connectors, in particular electrical connectors with family seals.

2. Description of the Prior Art

Single piece stamped and formed electrical receptacle terminals are often provided where compact and cost-effective electrical terminals are required. For example in European Patent 178 102 a single piece stamped and formed electrical receptacle terminal is provided in a substantially box-shape comprising a bottom wall, side walls and a top wall defining a cavity for receiving a complementary terminal therein. The side walls have contact protrusions inwardly stamped for resiliently abutting the mating pin terminal, the side walls further provided with outwardly biased resilient locking lances for engaging a complementary shoulder in a cavity of a connector housing. It is typical with connectors having a high density of terminals (i.e. a small pitch between adjacent terminals) to be provided with a single sealing member at a wire receiving end of the housing. Such sealing member is typically made of an elastomer and comprises a plurality of holes through which the terminals are inserted as they are mounted into their respective cavities of the housing. Sharp edges of the contact may damage the seal during insertion. A particular problem arises when one or more of the terminals need to be extracted during maintenance or repair. In the design according to EP 178 102, the resilient locking lance would be damaged, and may also damage the seal during extraction. In larger two piece terminals, it is known to provide means (protrusions) adjacent the locking lances for protection thereof as shown in DE 41 31 470. For miniature single piece terminals as shown in EP 178 102 this is difficult to implement due to the compact size of the terminal and the lack of sufficient material adjacent the locking lance. The problem is particularly acute where the miniature terminal is provided as a substantially square cross-section profiled box-shape. The side walls along which the lances are provided are reasonably narrow in relation to the locking lance, i.e. the lance extends across a substantial part of the width of the side wall due to the requirement for a certain minimum strength. Cylindrical terminals face a similar problem.

SUMMARY OF THE INVENTION

It is an object of this invention to provide an improved single piece electrical terminal for insertion and extraction through a seal member. It would be desirable to provide such improved terminal in the form of a box-shaped receptacle terminal, in particular for miniature receptacle terminals with a substantially square or cylindrical cross-sectional profile.

Objects of this invention have been achieved by providing the invention according to claim 1. In particular a single piece electrical receptacle terminal is provided comprising a connection section and a contact section with a mating portion for contacting a mating terminal in an axial direction, and a base portion having a bottom wall, opposed top wall, and side walls forming a box shape, the terminal further comprising at least one resilient locking lance stamped out of at least one of the side walls and extending from an attachment end to a free end obliquely away from the side wall, wherein the base portion further comprises seal extraction guides disposed axially behind the locking lance free end in the direction of the connection section to enable smooth extraction of the terminal through a seal member passage, the extraction guides being in the form of protrusions stamped out of the base portion to a distance substantially at or beyond the locking lance free end with respect to the side wall.

Advantageously therefore, a single piece electrical terminal is provided for extraction and insertion through a seal without damage thereto. Particularly advantageous is the ability to provide such terminal in a miniature form, in particular a substantially square-profiled or cylindrical electrical receptacle terminal.

A further advantageous feature is the provision of lateral extensions proximate the free end of the locking lance which enables a smoother guide of a seal over the seal guide protrusions during insertion of the terminal through the seal.

Further advantageous features of this invention will be apparent from the following description, claims and drawings.

DETAILED DESCRIPTION OF THE PREFERRED EMBODIMENT

Figure 1:
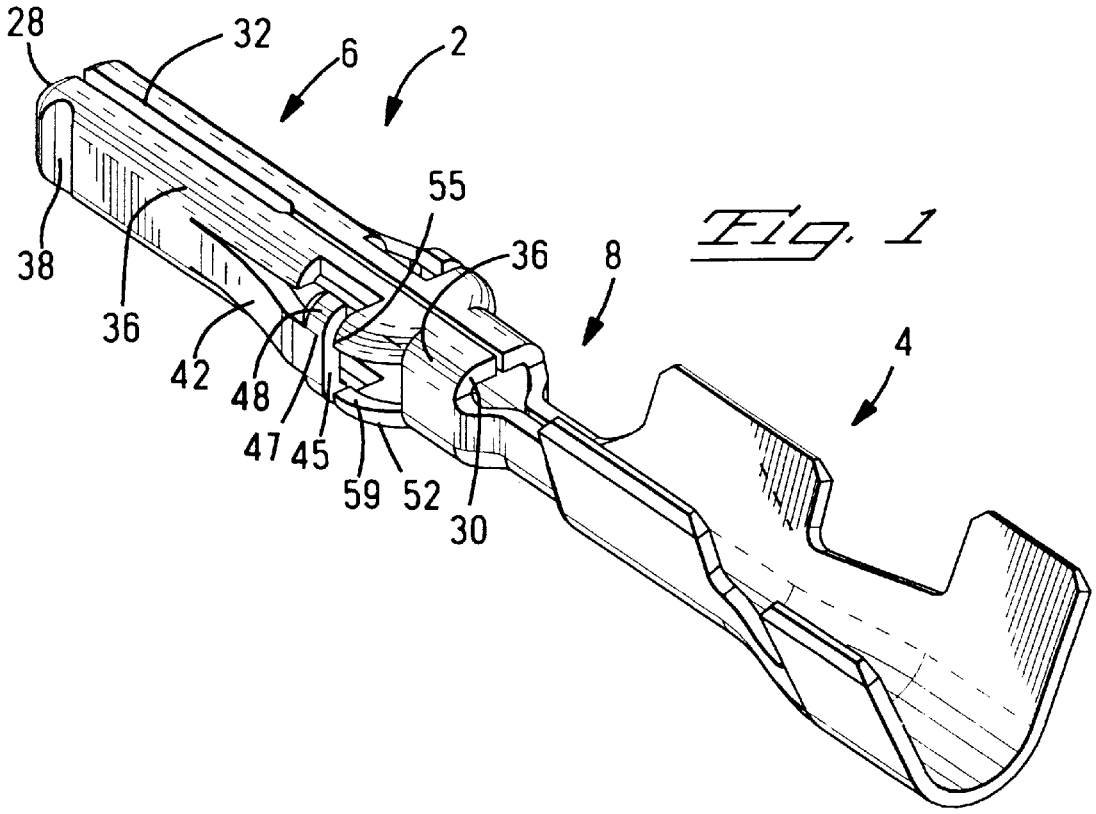
FIG. 1 is an isometric view of a terminal according to this invention.
Figure 2:
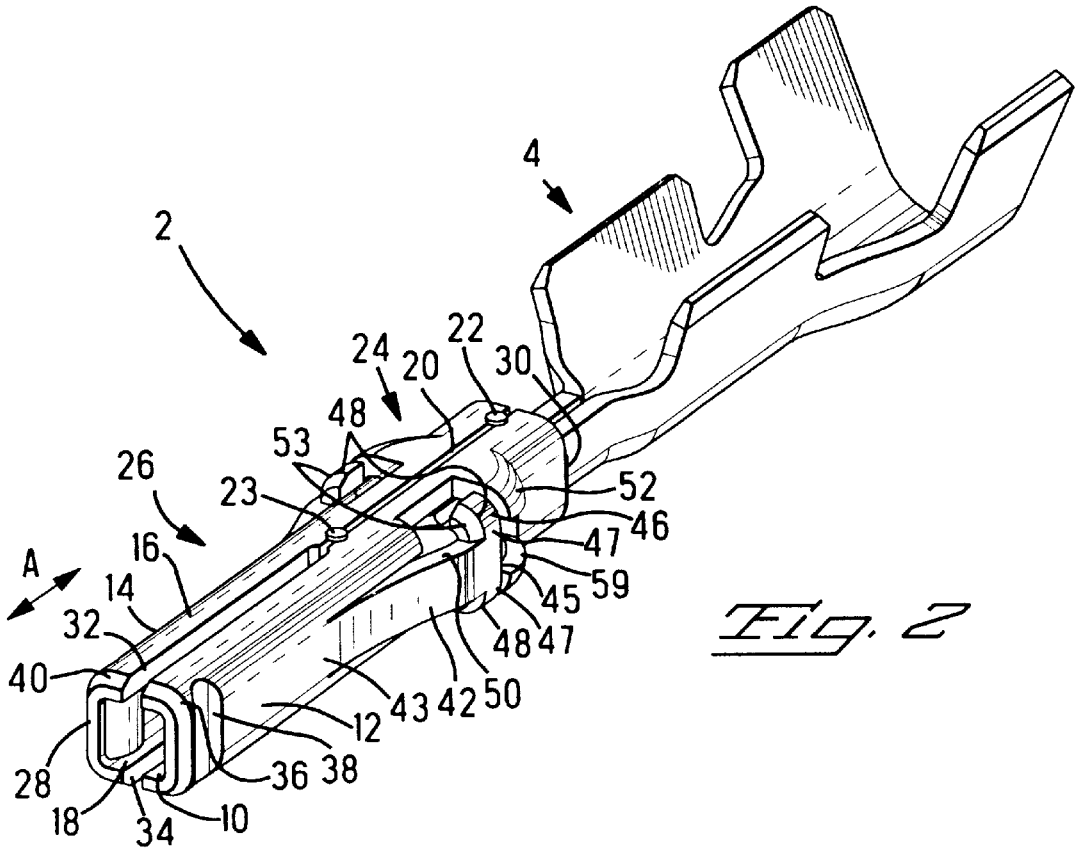
FIG. 2 is an isometric view from a front end of the terminal of FIG. 1.
Figure 3:
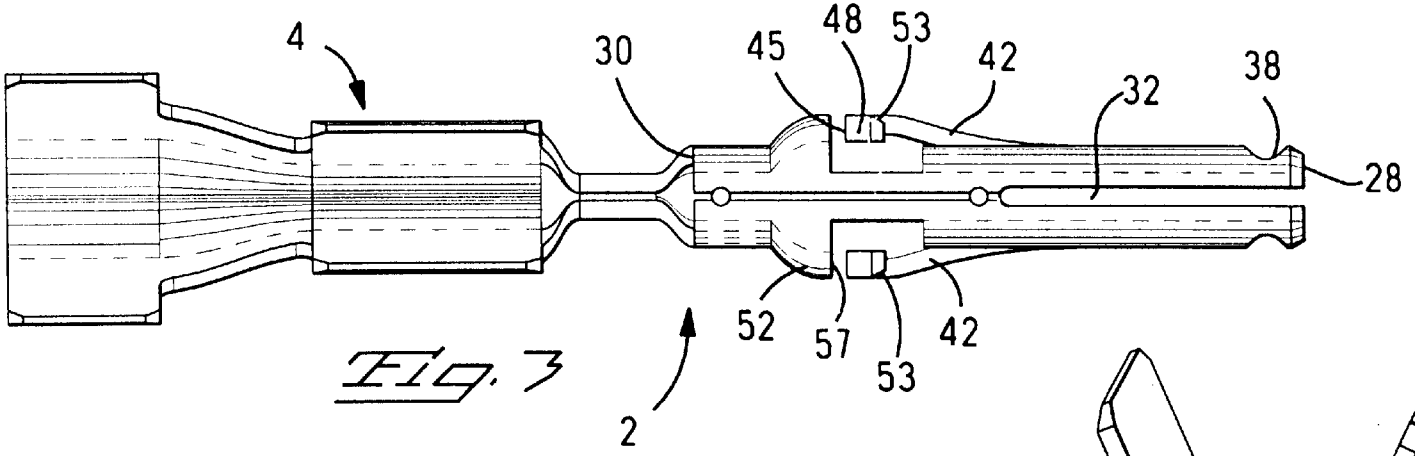
FIG. 3 is a top plan view of the terminal of FIGS. 1 and 2.

Referring to FIGS. 1–3, an electrical terminal 2 comprises a connection section 4 in the form of crimping arms for connection to a conducting wire, a contact section 6 and a transition section 8 therebetween. The connection section could also be provided in the form of insulation displacement or piercing contacts or with any other conventional connection means for contacting a wire, printed circuit board or other device.

The contact section 6 comprises a bottom wall 10, side walls 12,14 and a top wall 16 defining a mating terminal receiving cavity 18 surrounded by the walls. In this embodiment the top, bottom and side walls have substantially the same length such that a substantially square cross-sectional profile is provided. The top wall 16 comprises a seam 20 resulting from the folding together of sheet metal from which the terminal is stamped and formed, the seam being held rigidly together by weld joints 22,23 at a portion of the top wall adjacent or towards the connection section 4. The seam 20 can be held together by other means such as interengaging crimp tabs or the like, as is conventional with stamped and formed terminals. The secure attachment of the seam ensures a rigid base portion 24 of the contact section 6 for a relatively rigid support of a terminal receiving portion 26 of the contact section 6.

The contact section 6 extends from a mating end 28 where the mating terminal is received, to a connection end 30 proximate and facing the connection section 4. The top and bottom walls are further provided with axially extending slots 32,34 substantially centrally positioned between the opposed side walls 12,14 and extending from the mating end 28 to the base portion 24. The axial direction (A) is defined as the direction of insertion or mating of a complementary tab or pin terminal in the cavity 18 of the contact section 6. The top and bottom walls are integrally connected to the side walls 12,14 through arcuate corner portions 36. In view of their transverse or substantially orthogonal orientation with respect to the side walls the top and bottom walls, rigidify the side walls 12,14 with respect to a force biasing the side walls apart. The side walls 12,14 are provided with contact protrusions 38 proximate the mating end 28 for resiliently engaging a mating tab inserted therebetween. The side walls 12,14 act as resilient cantilever beam contact arms that are rigidified by extending integrally through the corners 36 into the top and bottom walls. The slots 32 are provided to control the flexibility of the contact arms in order to enable sufficient elastic deformation of the arms during mating. The top, bottom and side walls are provided with an outer taper 40 at the mating end 28 in order to enable smooth insertion of the terminal through a seal. Large radii 36 between the top, bottom and side walls further ensure a particularly smooth insertion of the box-shaped contact section through a seal, which is typically provided with cylindrical passages.

The contact protrusions 38 are embossed from the side walls 12, in this embodiment in a substantially cylindrical form extending orthogonally to the axial direction (A). The provision of the protrusions proximate the mating end 28 ensures on the one hand early contact with a mating terminal, and on the other hand acts where the flexibility of the contact arms is at its greatest. The line contact of the cylindrically profiled protrusions 38 (which for example may also have an electrical or V-shaped profile extending transversely) reduces specific wear on a mating contact in comparison to provision of contact points. Due to the high contact force that can be provided by the interconnection of the side and top and bottom walls, a high contact pressure is generated which can advantageously be spread across the contact "line" of the protrusion 38.

The side walls 12,14 are further provided with resilient locking lances 42 in the shape of cantilever beams attached at an attachment end 43 positioned roughly centrally between the mating and connection ends 28,30 respectively, and extending therefrom obliquely outwards to free ends 45 directed towards the connection section 4. The lances 42 are resiliently inwardly biasable for passage past retention shoulders in a cavity of a connector housing and for locking therebehind in the fully assembled position. The lance 42 is provided with a seal passage in section guide 46 in the form of extensions 48 extending laterally from lateral edges 50 of the lance 42 i.e. extending transversely to the axial direction (A) from the lateral edges 50 proximate the free end 45. The extensions 48 are radiused such that they curve in from a plane substantially parallel to the side wall 12 to a plane substantially parallel or approaching the plane of the top and bottom walls. In other words, the extensions 48 form radiused corners similar to the box corners 36 for smooth insertion through a seal cavity. The purpose of the extensions 48 is principally to assist smooth insertion of the terminal contact section 6 through a seal passage, in particular to guide the seal passage smoothly over bulbous (rounded) extraction guides 52 positioned axially spaced from the lance in the direction of the connection section 4.

There is an extraction guide 52 extending from each corner of the base section 24 such that each seal guide is partially formed from the side walls 12,14 and top and bottom walls 16,10 respectively. The seal extraction guides 52 extend from the side walls 12,14 to a distance from the side wall substantially at or beyond the distance of the locking lance free end 45 in order to enable the seal wall to pass over the locking lance free end 45 during extraction of the terminal from the connector. In this way, the seal may smoothly pass over the locking lance without damage to the seal or the locking lance. As the extraction guides 52 are provided at corners behind the locking lance free end 45, they ensure guidance of the seal over the corners 47 of the locking lance free end 45. The latter is particularly important as the corners are usually the most aggressive parts of the locking lance in terms of catching or digging into the seal.

During insertion, the extensions 48 ensure that the seal smoothly passes over the extraction seal guides 52 disposed behind the free end 45. The extensions 48 can be provided with tapered leading ends 43 facing the mating end to smoothly guide the seal thereover.

Figure 4:
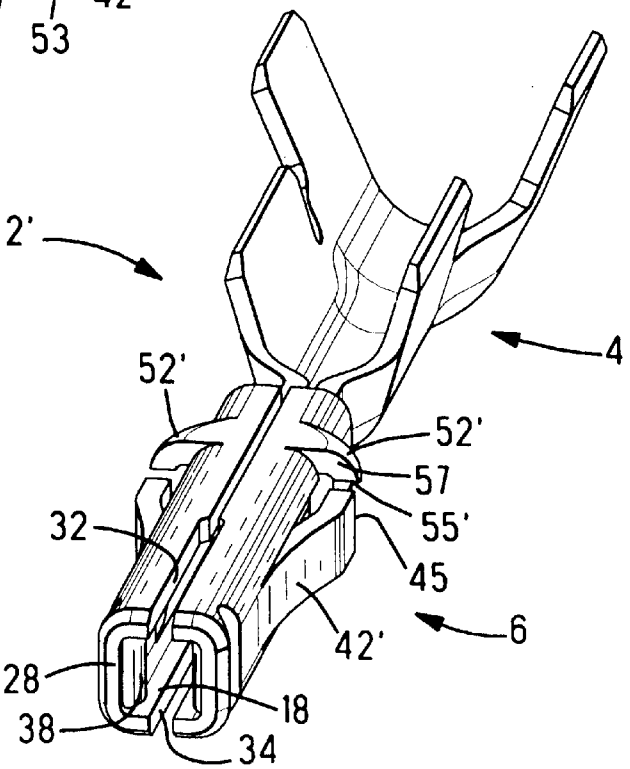
FIG. 4 is an isometric front view of a second embodiment of this invention.
Figure 5:
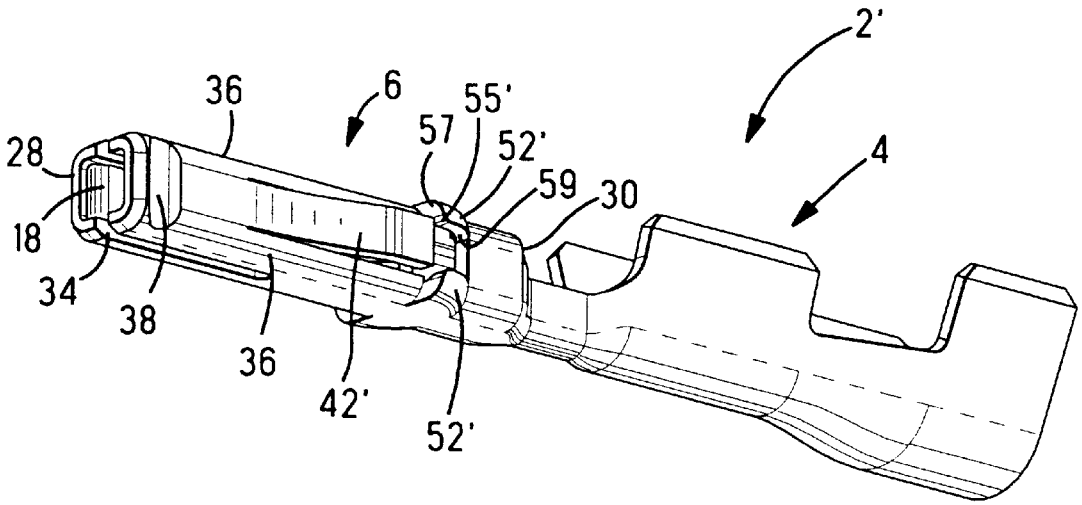
FIG. 5 is another isometric view of the terminal of FIG. 4.
Figure 6:
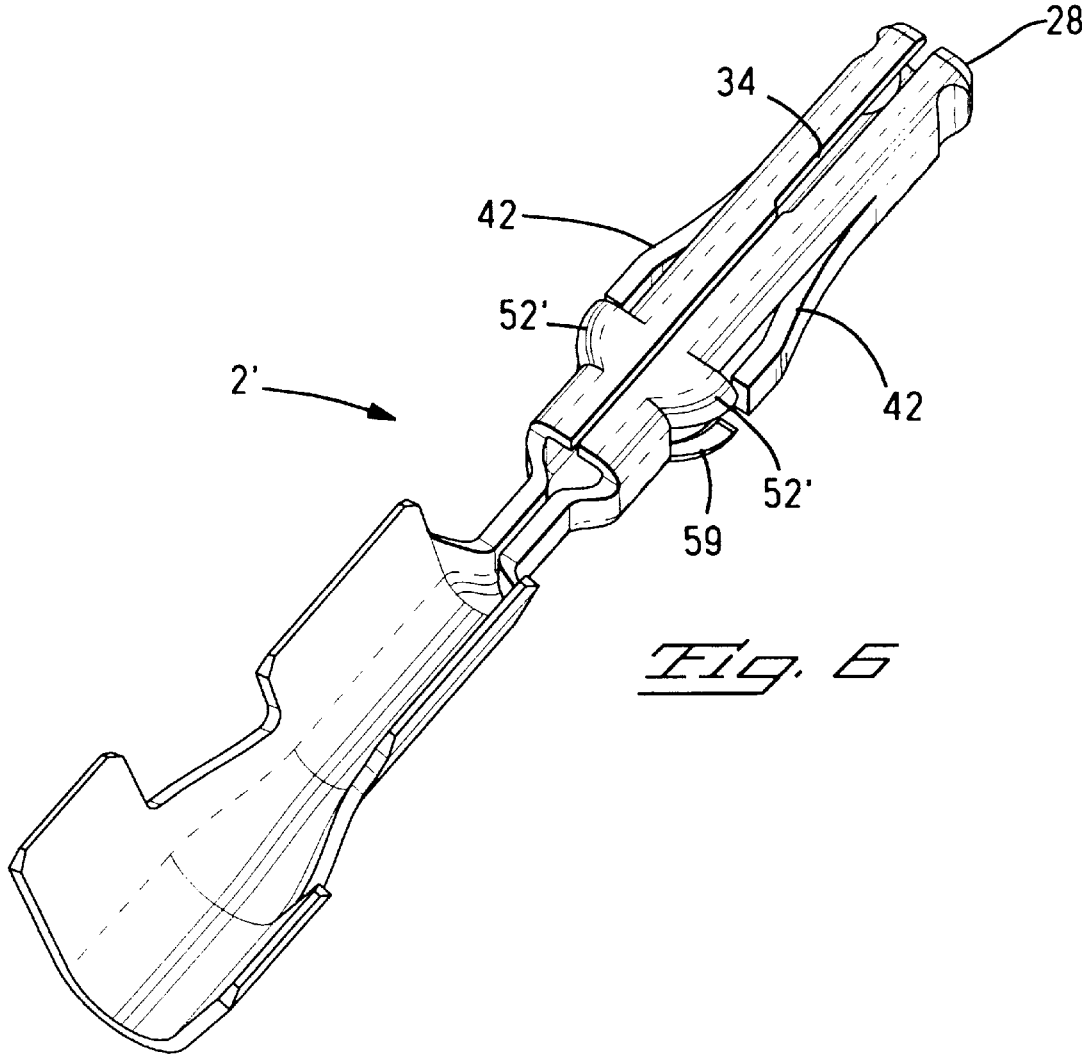
FIG. 6 is a further isometric view from a wire connection end of the terminal of FIGS. 4 and 5.

Referring now to FIGS. 4–6 another embodiment according to this invention is shown whereby the lances 42 are provided without lateral seal insertion guides in comparison to the embodiment of FIGS. 1–3. In both embodiments the same numbering is used for substantially identical features, where features having the main differences are given a prime. The seal extraction guides 52' have a bulbous embossed shape similar to the embodiment of FIGS. 1–3 and are provided with a rounded corners 551. The corners 55,55' of both embodiments join the sheared surface 57 facing the mating end 28 to the sheared surface 59 that faces the opposed sheared surface of the guide 52,52' on the opposed side of the locking lance 42, the sheared side 59 being sheared from the side wall 12. The rounded corner 55' provides a smoother corner/edge to prevent the extraction guides 52' from damaging the seal during insertion of the terminal therethrough. The embodiment of FIGS. 1–3 could also be provided with the rounded corner 55' of the embodiment of FIGS. 4–6.

The provision of the seal extraction guides 52,52' of both embodiments, positioned axially behind the end 45 of the locking lance 42 enables a particularly compact single piece electrical terminal to be provided for safe insertion and extraction through a seal. The opposed edges 59 of the pair of the extraction guides 52,52' on either side wall can also be used to receive the retention protrusion provided in a housing cavity for engaging the locking lance 42, which enables secure location and seating of the terminal within a housing cavity. The seal extraction guides 52,52' can advantageously be sheared from the corner 36 joining the side and bottom or top walls respectively that is provided with a radiused shape such that the guides are also advantageously provided with the rounded radius shape. The same features for seal extraction/insertion described hereinabove could advantageously be applied to substantially cylindrically shaped contact sections which face similar problems of locking lance protection. Relating the above description to a square profiled contact section to a substantially circular profiled contact section can be effected by imagining that the radii of the corners 36 are large enough to join together to form a cylinder.

I/we claim:

1. A single piece electrical terminal stamped and formed from sheet metal and comprising a connection section and a contact section with a mating portion for contacting a mating terminal in an axial direction and a base portion having a bottom wall, opposed top wall, and side walls forming a box shape, the terminal further comprising at least one resilient locking lance for retaining the contact in a cavity of a connector housing stamped out of one of the side walls and extending obliquely and outwardly away from the one of the side walls from an attachment end to a free end, characterized in that the base portion further comprises a seal extraction guide disposed between the locking lance free end and the connection section, the extraction guide extending out of the base portion to a distance substantially at or beyond the locking lance free end with respect to the side wall, thereby enabling smooth extraction of the terminal through a seal member passage.

2. The terminal of claim 1 wherein the terminal top and bottom walls extend into the side walls through rounded corners, the seal extraction guides being embossed out of the corners.

3. The terminal of claim 2 wherein the contact section has substantially rounded corners.

4. The terminal of claim 1 wherein a pair of seal extraction guides are provided for each lance, one seal extraction guide proximate each corner of the lance free end, the corners defined by the joining of the lance free end with respective lateral edges of the lance.

5. The terminal of claim 4 wherein a pair of the seal extraction guides comprise opposed sheared edges forming a slot therebetween for receiving a housing protrusion therethrough for engagement with the lance.

6. The terminal of claim 1 wherein the locking lance is provided with lateral extensions at the free end extending from lateral edges of the lance for guiding, during insertion of a terminal through a seal, a seal passage wall over the extraction guides situated therebehind with respect to the axial direction.

7. The terminal of claim 6 wherein the lateral extensions extend through a corner, from a direction substantially parallel to the side wall to a direction approaching or substantially parallel to the top or bottom wall respectively.

8. The terminal of claim 6 wherein the lateral extensions have tapered corners facing a mating end of the contact section for smooth passage of a seal therepast during insertion of the terminal through a seal member.

9. The terminal of claim 1 wherein the mating portion of the contact section has a substantially square cross-sectional profile where the cross-section is taken orthogonal to the axial direction.

10. The terminal of claim 9 wherein the contact section comprises axially extending slots arranged substantially centrally between opposed side walls in top and bottom walls respectively, the slots extending from a mating end of the mating portion where the mating terminal is received to a position proximate the base portion for increasing the suppleness of the side walls with respect to resilient biasing apart thereof.

11. The terminal of claim 9 wherein the side walls comprise embossed contact protrusions proximate the mating end, the contact protrusions embossed substantially across the whole width of the side walls between top and bottom walls.

* * * * *